US005816268A

United States Patent [19]

Awaijane

[11] Patent Number: 5,816,268

[45] Date of Patent: Oct. 6, 1998

[54] HAIR HIGHLIGHTING METHOD AND APPARATUS

[76] Inventor: George Awaijane, 208 S. Meadow La., Golden Valley, Minn. 55416

[21] Appl. No.: 852,581

[22] Filed: May 7, 1997

[51] Int. Cl.[6] ..... A61K 7/13; A61K 7/135

[52] U.S. Cl. ..... 132/208; 132/270; 132/200

[58] Field of Search ..... 132/208, 202, 132/207, 200, 222, 270, 221; 221/1, 124, 210; 206/494

[56] References Cited

U.S. PATENT DOCUMENTS

| | | | |
|---|---|---|---|
| 2,139,311 | 12/1938 | Moore . | |
| 3,109,438 | 11/1963 | Work | 132/31 |
| 3,349,781 | 10/1967 | Poole et al. | 132/7 |
| 3,548,842 | 12/1970 | McCall | 132/9 |
| 3,618,620 | 11/1971 | Williams | 132/9 |
| 3,749,105 | 7/1973 | Sestita | 132/7 |
| 3,800,811 | 4/1974 | Esposto | 132/9 |
| 3,861,405 | 1/1975 | Pellecchia | 132/9 |
| 3,921,647 | 11/1975 | Fisher | 132/9 |
| 3,941,613 | 3/1976 | Nicoletti | 132/9 |
| 4,196,741 | 4/1980 | Minghenelli | 132/9 |
| 4,224,954 | 9/1980 | Stahl | 132/7 |
| 4,552,159 | 11/1985 | Fabbri et al. | 132/207 |
| 4,672,983 | 6/1987 | Nath et al. | 132/7 |
| 4,880,019 | 11/1989 | Roubo | 132/270 |
| 4,942,893 | 7/1990 | Trottier | 132/208 |
| 4,962,775 | 10/1990 | Squatrito | 132/222 |
| 4,991,738 | 2/1991 | Peterson | 221/1 |
| 5,007,443 | 4/1991 | Fulgoni | 132/270 |
| 5,056,538 | 10/1991 | Matula | 132/208 |
| 5,056,539 | 10/1991 | Abramson | 132/270 |
| 5,058,609 | 10/1991 | Sandoz et al. | 132/270 |
| 5,146,937 | 9/1992 | Lefebvre | 132/208 |
| 5,156,172 | 10/1992 | Tancredi | 132/270 |
| 5,287,864 | 2/1994 | Gallo | 132/208 |
| 5,335,679 | 8/1994 | Baxter | 132/270 |
| 5,349,970 | 9/1994 | Razzouq | 132/208 |
| 5,433,225 | 7/1995 | Liggett et al. | 132/208 |
| 5,535,764 | 7/1996 | Abramson | 132/200 |
| 5,549,126 | 8/1996 | Green | 132/270 |
| 5,664,590 | 9/1997 | Plateroti et al. | 132/270 |

*Primary Examiner*—Gene Mancene
*Assistant Examiner*—Pedro Philogene
*Attorney, Agent, or Firm*—Schwegman, Lundberg, Woessner & Kluth, P.A.

[57] ABSTRACT

A device for applying agents, such as coloring agents, to selected strands of hair includes a first sheet of foil and a second sheet of foil. The first sheet of foil has a first folded end and a first free end. The second sheet of foil also has two ends, namely a second folded end and a second free end. The first sheet and the second sheet are arranged so that the first folded end wraps around the second free end of the second sheet, and so that the second folded end wraps around the first free end of the first sheet. This provides for thicker ends for easy pick up of the sheets and also keeps the sheets together as they are picked up. In addition, after the chemical has been placed onto the hair, the folded ends are closest to the scalp which provides for added strength at the scalp and for better sealing of the foil. A plurality of the first and second sheet assemblies can be placed into a box for dispensing. Two sheets of material are placed adjacent one another, and then one edge of the two sheets of material is placed near the scalp of a person. Strands of hair are selected. Then chemicals are applied to the selected strands of hair. To form a sealed container one of the two adjacent sheets is removed and placed atop the other sheet. The edges of the sheet can then be crimped together to form a sealed container. After a prescribed treatment time, the sheets are removed and the hair is washed.

16 Claims, 6 Drawing Sheets

HAIR HIGHLIGHTING METHOD AND APPARATUS

FIELD OF THE INVENTION

The present invention relates generally to a method and apparatus for treating hair. More particularly, the present invention relates to methods and apparatus used for adding selected amounts of coloring agents to highlight or frost a person's hair with the use of foil.

BACKGROUND OF THE INVENTION

In recent years, it has become fashionable to highlight and the hair to add interest and attractiveness. While this practice might seem simple to the layman, professional hair colorists and those individuals who have attempted to streak or highlight their own hair or that of another realize that considerable skill and technique is necessary to obtain even a passable job and that truly professional results are very difficult to achieve. For this reason, many techniques have been developed for highlighting and streaking hair which have various advantages and disadvantages and which provide varying degrees of success, depending upon the skill of the operator and other factors.

There are three generally recognized methods of highlighting, that is, cap highlighting, combing, and foiling. In cap highlighting, the client's hair is covered with a cap made of a flexible material such as rubber which has a multiplicity of small holes. An instrument, such a crochet needle, is used to pull selective strands of hair through the holes; color or bleach is then applied to the strands. The stylist waits a definable time period for the color or bleach to set properly, removes the cap, and washes the hair. The result is a selective coloring or bleaching of the hair. This method is subject to a number of problems. The liquid often"bleeds" through the holes in the cap and the bleach or coloring spreads unevenly to strands or portions of hair not intended to be highlighted, causing a spotted look. Further, pulling the hair through the cap holes is often painful if too much pressure is applied by the hair stylist. The cap method is also difficult to use when the object is merely to"touch up" the roots of those strands that were previously highlighted without adding further color or bleach to the already highlighted hair.

The combing method employs a comb which is dipped into the liquid to be applied and is then pulled through the hair. This method is usually employed where relatively large swatches of hair are to be highlighted. It is difficult to regulate and particularly vulnerable to"bleeding" of the liquid to other portions of the hair.

An excellent, but very difficult technique, is the basic foil method in which a sheet of aluminum foil is held under the hair to be treated. The hair to be treated or colored is first woven by well-known techniques and then a sheet of aluminum foil is held against the scalp and hair of the head with the edge of the foil as closely adjacent to the roots of the hair to be treated as possible. The desired bleach, dye, or other product is then applied to the hair so isolated. The lower free end of the aluminum foil is folded or rolled toward the head until out of the way of the next portion of hair to be treated. The sides are then folded inwardly to form a crimped envelope or package, completely enclosing the treated hair. The hair is allowed to process for the required period of time and then the foil package is removed. Normally, the plurality of portions of hair that are treated in this manner aggravates the problem of holding the foil in place, both during application of the treating agent and during processing. This requires great care and more than one pair of hands so that an assistant must be employed to do the tedious and exacting job of holding the foils in place. Any movement of the person's head or a slip by the operator or assistant leads to spotting or bleaching where it is not wanted. While this method can provide excellent results and close bleaching at the root of the hair, it is very difficult to perform properly. Also, it is expensive that extra time is necessary for cutting the sheets of foil and to holding them in place.

Many techniques have been used in the past to improve or ease the foil method of treating hair. Tools have been used to apply the foil. The tool is a flat piece of wood about one-eighth inch in thickness and approximately four inches wide and five inches long. The paddle has a handle on it so that a person can hold it with one hand while applying bleach, or any other hair lightening product, with the other hand. This technique is very time-consuming and insufficient for various reasons. First, the use of one hand to hold the paddle leaves the second hand with all the work from applying the foil on the paddle to weaving the hair, applying the product on the paddle and folding the foil. This results in low speed application that can take anywhere from two to three hours. The thickness of the wood results in the inability to get full coverage for the weaved hair. This, in turn, results in uneven application and uneven or incomplete hair color. In most cases, an assistant is required either to hold the paddle, cut the foil, or to apply color. In all of these instances, the client is very unhappy to have to sit in the chair for three hours. This is extremely discouraging to the client and generally results in dissatisfied customers.

In the past, various U.S. patents have issued relating to the various techniques for coloring and treating hair. U.S. Pat. No. 3,349,781, issued on Oct. 31, 1967, to R. J. Poole describes a coloring or bleaching method in which entire layers of hair are simultaneously treated with bleach so as to produce contrasting streaks in the hair. A special applicator is provided which is a brush having spaced series of tufts of bristles. The treatment is carried out over a protective sheet of aluminum foil.

U.S. Pat. No. 3,921,647, issued on Nov. 25, 1975, to K. C. Fisher describes an apparatus for chemically treating selected bundles of hair. This apparatus includes a clamping platform and a clip slidable therein. The platform includes a pair of jaws and a planar surface with the surface being disposed substantially orthogonal to the jaws. The selected hair is captured in the jaws so as to allow the planar surface to press against the hair directly thereunder and the scalp. A foil sheet is interposed and held by action of the planar surface and the scalp so as to achieve isolation of the selected bundle of hair.

U.S. Pat. No. 4,074,964, issued on Feb. 21, 1978, to H. D. Wells provides a method of coloring hair which consists of parting the hair in a manner so as to define a plurality of individual hair sectors on the scalp. A hairdresser's tape is applied to the scalp along all of the part lines and a double-side adhesive tape is applied over the hairdresser's tape. One or more hair tressed segments are wrapped in rectangular pieces of liquid impervious sheet material. The packets are adhesively held in this position during the hair treatment.

U.S. Pat. No. 4,196,741, issued on Apr. 8, 1980, to S. M. Minghanelli provides a liquid-impermeable sheet, made of aluminum foil, having a coating of pressure-sensitive adhesive. The process of this method involves separating a portion of hair to be treated, adhering one of the liquid-impermeable sheets to the scalp, and treating the selected portion of hair with a desired liquid-treating agent. The sheet is folded or rolled toward the head and the edges are folded inwardly so as to form an envelope.

U.S. Pat. No. 4,224,954, issued on Sep. 30, 1980, to M. L. Stahl discloses a device for use in bleaching or coloring hair. This device includes a thin planar base member having a hand grip portion at one end and a generally U-shaped top member having a transverse span portion atop the base member, adjacent the hand grip portion. A pair of generally parallel arms or thin planar materials extend from the span portion. A moisture impervious flexible sheet of a suitable material, such as aluminum foil, is disposed between the base and the U-shaped top members. A lock of hair is disposed over at least a portion of the central area of the foil, and a hair coloring or bleaching fluid is applied thereto.

U.S. Pat. No. 4,658,840, issued on Apr. 21, 1987, to D. C. McCosker discloses a strip for facilitating the selective coloring of hair. A thin sheet of flexible elastic plastic material is provided which has a plurality of sets of openings. The openings are used to hold strands of hair which, in turn, hold the sheet to the scalp.

U.S. Pat. No. 4,672,983, issued on Jun. 16, 1987, to Nath et al., provides a method for performing a hair coloring treatment. This employs the use of a sheet of plastic material. The sheet of plastic material is folded along predetermined fold lines over and about a section of hair to be treated. This forms a generally closed pocket so as to allow the hair to be configured within the pocket for a desired period of time.

U.S. Pat. No. 5,056,539, issued on Oct. 15, 1991, to K. G. Abramson shows a product and method for coloring selective areas of hair. This device is an improved method for foiling hair by using a segment of aluminum foil having two window panes of transparent material arranged equidistant from each other such that when the foil is folded in half, the two panes are aligned one on top of the other.

It is an object of the present invention to provide an improved foiler which greatly speeds the process of treating hair.

The methods and apparatus used to date are generally very complex solutions. In each of the solutions, a single hairdresser still has difficulty in manipulating the customer's hair while reaching for another foil or some other specialized tool. The specialized solutions still remain expensive, time consuming and difficult to use.

SUMMARY OF THE INVENTION

A device for applying chemical agents, such as coloring agents, to selected strands of hair includes a first sheet of foil and a second sheet of foil. The first sheet of foil has a first folded end and a first free end. The second sheet of foil also has two ends, namely a second folded end and a second free end. The first sheet and the second sheet are arranged so that the first folded end wraps around the second free end of the second sheet, and so that the second folded end wraps around the first free end of the first sheet. This provides for thicker ends for easy pick up of the sheets and also keeps the sheets together as they are picked up. In addition, after the chemical has been placed onto the hair, the folded ends are closest to the scalp which provides for added strength at the scalp and for better sealing of the foil. A plurality of the first and second sheet assemblies can be placed into a box for dispensing.

A method for applying chemicals to hair is also disclosed. Two sheets of material are placed adjacent one another, and then one edge of the two sheets of material is placed near the scalp of a person. Strands of hair are selected. Chemicals are then applied to the selected strands of hair. To form a sealed container one of the two adjacent sheets is removed and placed atop the other sheet. The edges of the sheet can then be crimped together to form a sealed container. After a prescribed treatment time, the sheets are removed and the hair is washed.

Advantageously, the device for applying chemicals to hair or the hair highlighting apparatus is much easier for a hairdresser to handle than previous methods such as using separate sheets of foil. The hair highlighting apparatus is thicker and easier to handle than the single separate sheet of foil previously used. Two sheets are delivered in each hair highlighting apparatus or device which makes the hair professional's job easier. In addition, the method and apparatus described provides a strong straight edge near the scalp 610 of the client 600. This strong edge can be used to get the foil closer to the scalp of the client and the strong, folded edge provides superior sealing strength for the chemical or coloring agents between the first sheet and the second sheet of the hair highlighting apparatus. Yet another advantage of this particular invention is that the amount of foil needed can be reduced by as much as 20 to 30%. In previous applications, about 20 to 30% of the foil was wasted. When dimensioned properly, a savings of 20 to 30% of the foil is achieved. Another advantage is that the hair highlighting method using the hair highlighting apparatus saves tremendous amounts of time.

BRIEF DESCRIPTION OF THE DRAWINGS

For a better understanding of the present invention, reference may be made to the accompanying drawings in which.

DESCRIPTION OF THE EMBODIMENT

In the following detailed description of the embodiment, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the present inventions. The following detailed description is, therefore, not to be taken in a limiting sense, and the scope of the present inventions is defined only by the appended claims.

Figure 1:
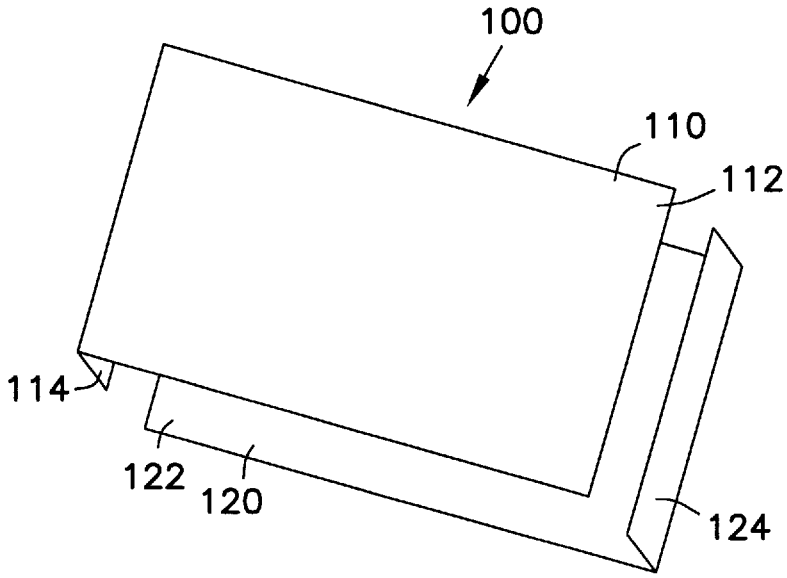
FIG. 1 is an exploded isometric view of a device for applying chemical agents to selected strands of hair.

FIG. 1 shows an exploded isometric view of a device for applying chemical agents to selected strands of hair. The device is most commonly used for applying coloring agents to selected strands of hair to achieve a highlight or frosting of a client's hair. Therefore, the device shown in FIG. 1 can also be thought of as a hair highlighting device 100. The hair highlighting device 100 includes a first sheet of foil 110 and a second sheet of foil 120. The first sheet of foil 110 includes a free end 112 and a folded end 114. The second sheet of foil 120 includes a free end 122 and a folded end 124. The first 110 and the second 120 sheets of foil have substantially the same dimensions. The dimensions of the two sheets 110, 120 can be varied to accommodate different lengths of hair. The width of the two sheets 110, 120 stays approximately the same. The width dimension accommodates several strands of hair from an area of the scalp.

Figure 2:
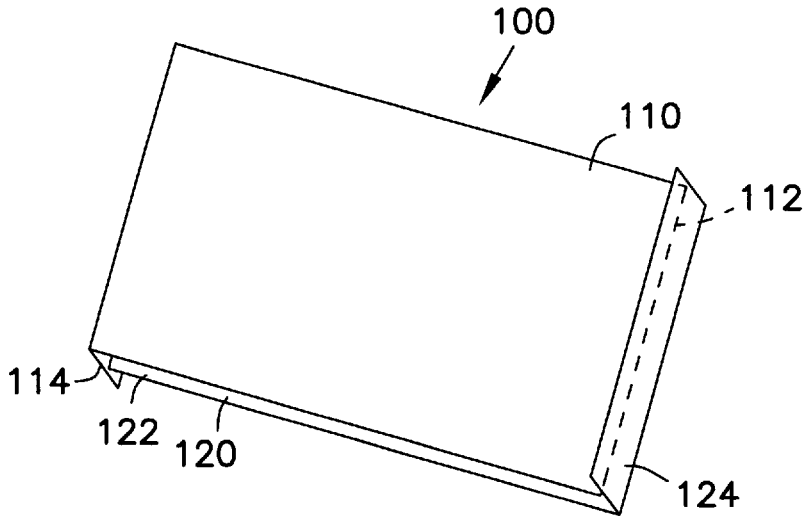
FIG. 2 is an isometric view of a device for applying chemical agents to selected strands of hair in a nearly assembled position.

As shown in FIG. 2, the free end 112 of the first sheet 110 is tucked into the folded end 124 of the second sheet 120. Similarly, the free end 122 of the second sheet 120 is tucked into the folded end 114 of the first sheet 110. The free ends 112 and 122 are then nested or placed within the folded ends 124 and 114, respectively. The two hair foils 110 and 120 can also be described as interleaved. After the free end is nested into a folded end, the folded ends are further flattened to form the apparatus for use in applying agents to selected strands of hair 100.

Figure 3:
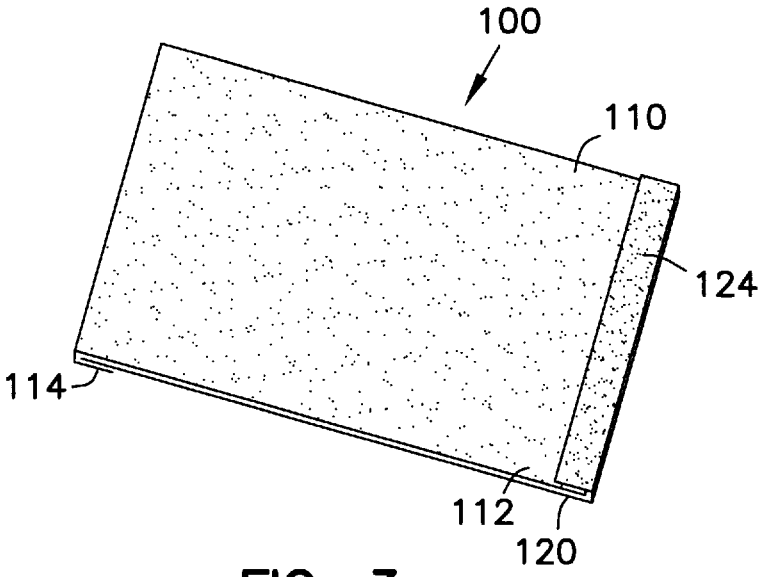
FIG. 3 is an isometric view of an assembled device for applying chemical agents to selected strands of hair.
Figure 4:
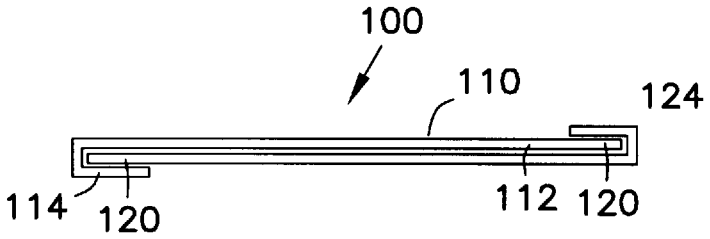
FIG. 4 is a cross-sectional view of an assembled device for applying chemical agents to selected strands of hair.

The final assembly of the hair highlighting device 100 is shown in FIGS. 3 and 4. In FIGS. 3 and 4, the folded end 124 and folded end 114 have been substantially flattened. The free ends 112 and 122 are caught or captured within the folded ends 124 and 122, respectively. FIG. 4 is not drawn to scale. The scale used more clearly shows the detail of nesting or the capturing of both free ends 112 and 122 by the folded ends 124 and 114. The embodiment shown in FIGS. 3 and 4 includes a stippled or textured typed of material. The stippled surface or texturing enables the first sheet 110 and the second sheet 120 to slide with respect to each other. The stippled or textured surface also makes the hair highlighting device 100 easier to pick up. Another preferred embodiment of the invention is the first sheet 110 and the second sheet 120 with a smooth surface. In the preferred embodiments, the material used is aluminum foil. Aluminum foil can be textured or it can be smooth, as is shown in the two embodiments of FIGS. 1–4. It should be noted that the material need not be aluminum foil and that other materials can also work. The material must be formable into sheets such as sheets 110 and 120 of the finally assembled hair highlighting device 100. The alternate material must be capable of containing chemicals and capable of being sealed.

Figure 5:
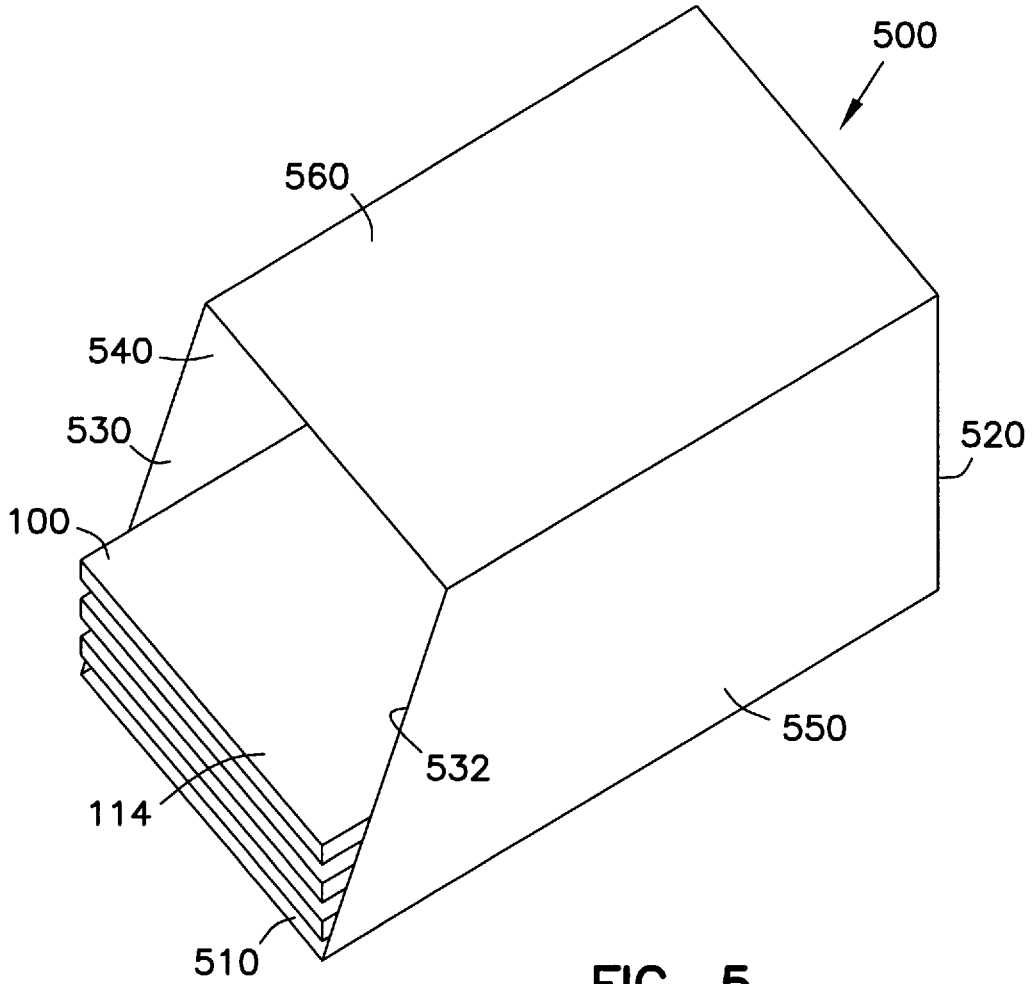
FIG. 5 is an isometric view of a dispenser box containing several devices for applying chemical agents to selected strands of hair.

Now turning to FIG. 5, an isometric view of a dispenser box is shown. Once the individual hair highlighting apparatus is formed, it is stacked into a dispenser box 500. The dispenser box has a floor 510 on which several hair highlighting devices 100 are stacked. The dispenser box has a closed end 520 and an open end 530. The dispenser 500 also has side walls 540 and 550, as well as a top 560. When the dispenser 500 is being shipped, the open end 530 is covered so that the dispenser 500 doubles as a shipping container. Perforations are placed into the end of the box which will become the open end 530. Upon receipt of the box, the end (not shown) is removed to form the opened end 530. Reference numeral 532 shows the perforated edge after the end (not shown) has been removed. The shipping container is thus turned into the dispenser 500 by removing an end of the box along the perforated edge 532. It should be understood that the perforations are strong enough so that the end stays attached during normal shipping. The perforations or the perforated edge 532 are also weak enough so that the end can be removed by the hairdresser who will use the hair highlighting apparatus 100 stacked inside the dispenser 500.

The assembled apparatus for applying agents to selected strands of hair 100 are stacked within the dispenser 500. The dimensions of the hair highlighting device 100 are slightly smaller than the dimensions of the floor 510 of the dispenser 500. When the individual hair highlighting apparatuses 100 are stacked into the box the folded edge at the opened end of the box 530 is positioned so that it is closest to the floor 510 of the box 500. It should be noted that the folded edge could also be facing upwardly or toward the roof of 560 of the dispenser 500.

In operation individual hair highlighting apparatuses 100 are removed one at a time by simply placing a finger on the top sheet of the hair highlighting apparatus and applying a slight force to move the edge of the individual hair highlighting apparatus 100 out beyond the stack of these devices 100. Once the edge is moved beyond the stack, the folded end is pinched or grasped by the hairdresser or person performing the frosting or highlighting operation. When the folded end 114 is pinched, this added force keeps the free end 122 of the second sheet 120 within the folded end 114. Typically, hair highlighting apparatus 100 is comprised of first and second sheets 110 and 120 which are sufficiently light weight so that grabbing the folded end 1 14 and removing the hair highlighting apparatus 100 from the stack will not cause the first sheet 110 to release from the interlocked second sheet 120.

Figure 6:
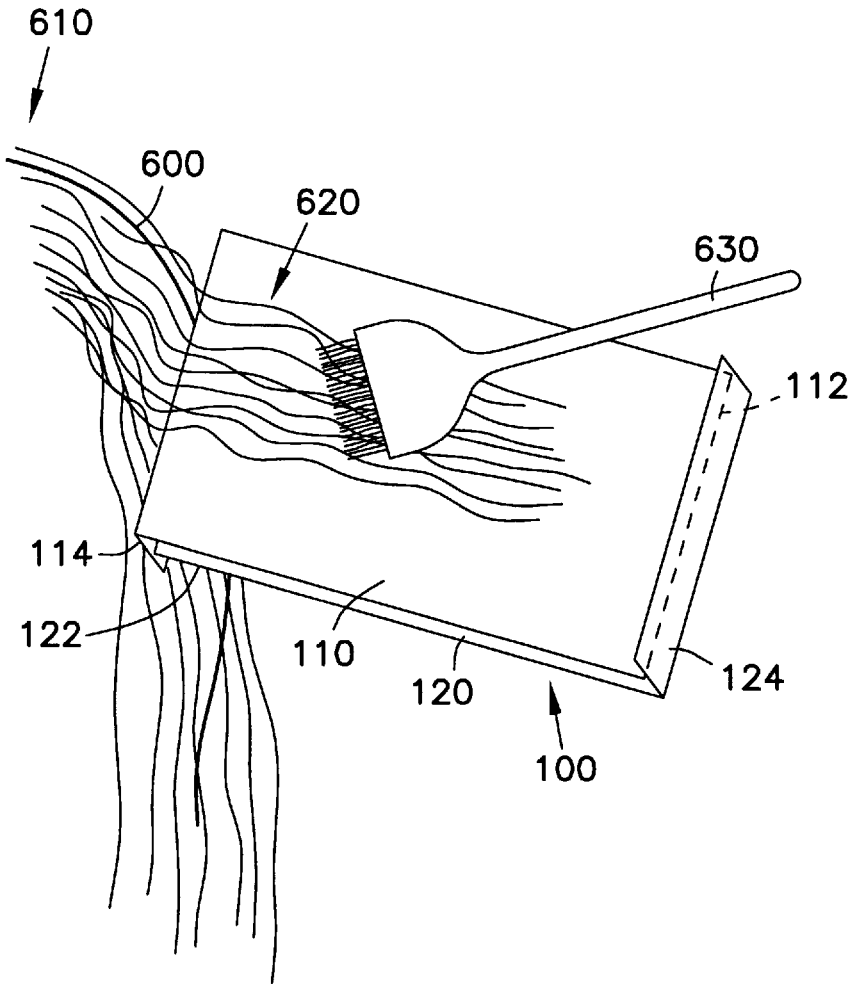
FIG. 6 is an isometric view of the device for applying chemical agents to selected strands of hair being used on a client's head.
Figure 7:
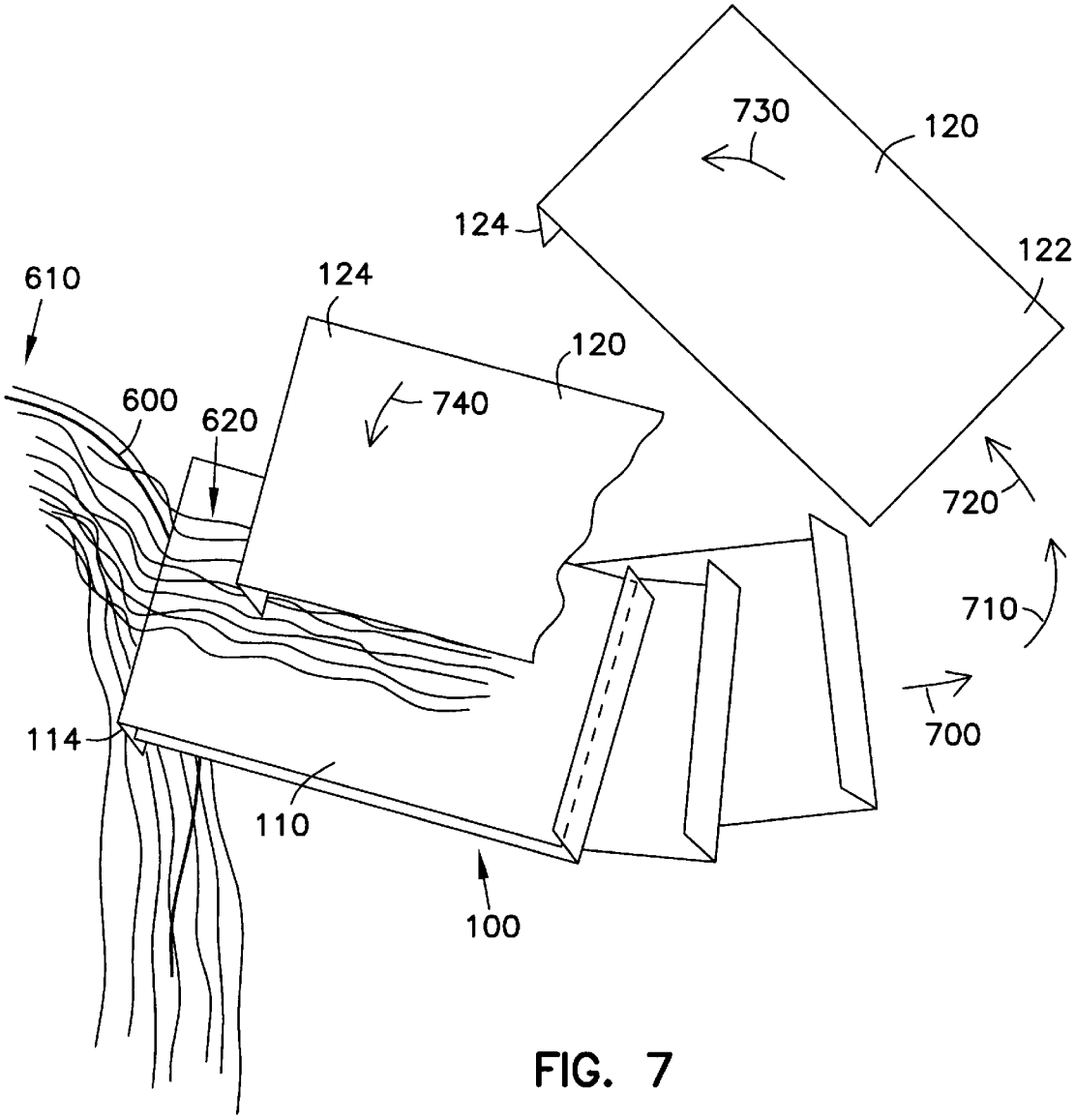
FIG. 7 is an isometric view of the device for applying chemical agents to selected strands of hair being used on a client's head to seal the chemical agents and strands of hair.

Now turning to FIGS. 6 and 7, the method for applying chemicals to the hair using the hair highlighting apparatus 100 will be further detailed. After removing an individual apparatus 100 from the dispenser box 500, the folded edge 114 is placed near the scalp 600 of a client 610. Individual strands of hair 620 are then selected by the hairdresser. Of course, groupings of strands of hair may also be selected by the hairdresser. Once the strands of hair have been selected, a brush 630 or similar apparatus is dipped into a chemical agent and applied to the strands of hair that are on or placed on the surface of hair highlighting apparatus 100. After the chemical agent has been applied to the selected strands 620, the brush is removed. Then the bottom or second sheet is removed and placed on top of the first sheet 110. This is shown in FIG. 7. The assembly 100 is supported by the hand of the hairdresser while the folded end 124 of the second sheet 120 is carefully removed from the assembly 100. This leaves the first sheet 110 in place with the folded edge 114 adjacent the scalp 600 of the client. The second sheet 120 is flipped and placed atop the first sheet 110 so that the folded edge 124 now is also adjacent the scalp 600 of the client 610. The arrows 700, 710, 720, 730 and 740 progressively show the flipping motion of the second sheet 120 as it is being removed from the assembly 100 and placed atop the first sheet 110.

Advantageously, the folded edges 114 and 124 are now adjacent the scalp 600 of the client 610. As a result, the strongest portions of the two sheets 110 and 120 are adjacent the scalp 600. The folded ends 114 and 124 also can be more easily crimped together to form a seal which will prevent the leakage of the chemical agent previously applied to the selected strands 620 of hair. Having the two folded portions 114 and 124 near the scalp prevents tearing of individual sheets 110 and 120 when the two sheets are crimped together to form a seal. Once the second sheet 120 is placed atop the first sheet 110, the edges can be folded or otherwise crimped together to seal in the chemical agent being applied to the selected strands of hair. This is advantageous since the selected agent is generally used to color the hair in a frosting or highlighting situation. If the chemical agent is not sealed between the first sheet 110 and the second sheet 120, the coloring agent will leak out and color an unselected portion of the scalp. Leakage is disastrous because an undesired blotch of dyed hair may result. The process shown in FIGS. 6 and 7 is repeated until all of the selected strands of hair 620 have been treated with the coloring agent or chemical agent desired. Once all of the selected strands have been placed in between sheets 110 and 120 and a selected amount of time elapses, the foils or the sheets 110 and 120 are removed from the individual strands or groups of strands of hair. The hair is then washed. The result is hair that is frosted or highlighted.

This particular method and apparatus has many advantages. One of the larger advantages is that it is much easier for a hairdresser to handle than previous methods. For example, hair highlighting was previously done by buying a number of sheets of foil. The sheets of foil were then cut to a desired dimension and stacked before the foiling operation would take place. The next step would be to take one sheet and place it near the scalp of the client. That first sheet would then be held in place while the strands of hair 620 were selected and then a brush 630 was used to apply the chemicals to the hair. The operator would then reach back to the stack of foils previously cut which could, of course, be located on some other surface such as on a desk behind the hairdresser or beautician. Thus, while the beautician or hairdresser was holding one foil, he or she would be trying to pick up yet another foil from a different location to add to the first foil. The foil is also thin which made it difficult to pick up. In short, the beautician or hairdresser trying to do this using individual foils would engage in a somewhat acrobatic exercise while trying to apply the foil and chemicals to the clients head. An additional disadvantage is that the edge adjacent the client's scalp 600 may be jagged and is certainly weak, so that when the foils were crimped together there could be leakage along that edge, thereby resulting in an undesirable blotch of colored hair.

The current method and apparatus described provides a strong straight edge near the scalp 610 of the client 600. This strong edge can be used to get the foil closer to the scalp of the client and, in addition, provides superior sealing strength for the chemical or coloring agents between the first sheet 110 and the second 120. In addition, the assemblies 100 are very easy to pick up since they are somewhat thicker than a single sheet of foil. Once the hair highlighting apparatus is picked up and placed on the scalp of the client, two sheets are proximate the clients scalp so that the operator merely has to pull the brush 630 down the strand of hair while supporting it, and then merely has to remove the second sheet 120 from the assembly 100 and place it atop the first sheet 110. The result is the elimination of the awkward acrobatic exercise previously performed by hairdressers and beauticians. A final advantage of this particular invention is that the amount of foil needed can be reduced by as much as 20 to 30%. In previous applications, about 20 to 30% of the foil was wasted. When dimensioned properly, a savings of 20 to 30% of the foil is achieved. It is also felt that beauticians and hairdressers will be willing to pay a premium for a dispenser full of appropriately dimensioned foils since it will save tremendous amounts of time.

Figure 8:
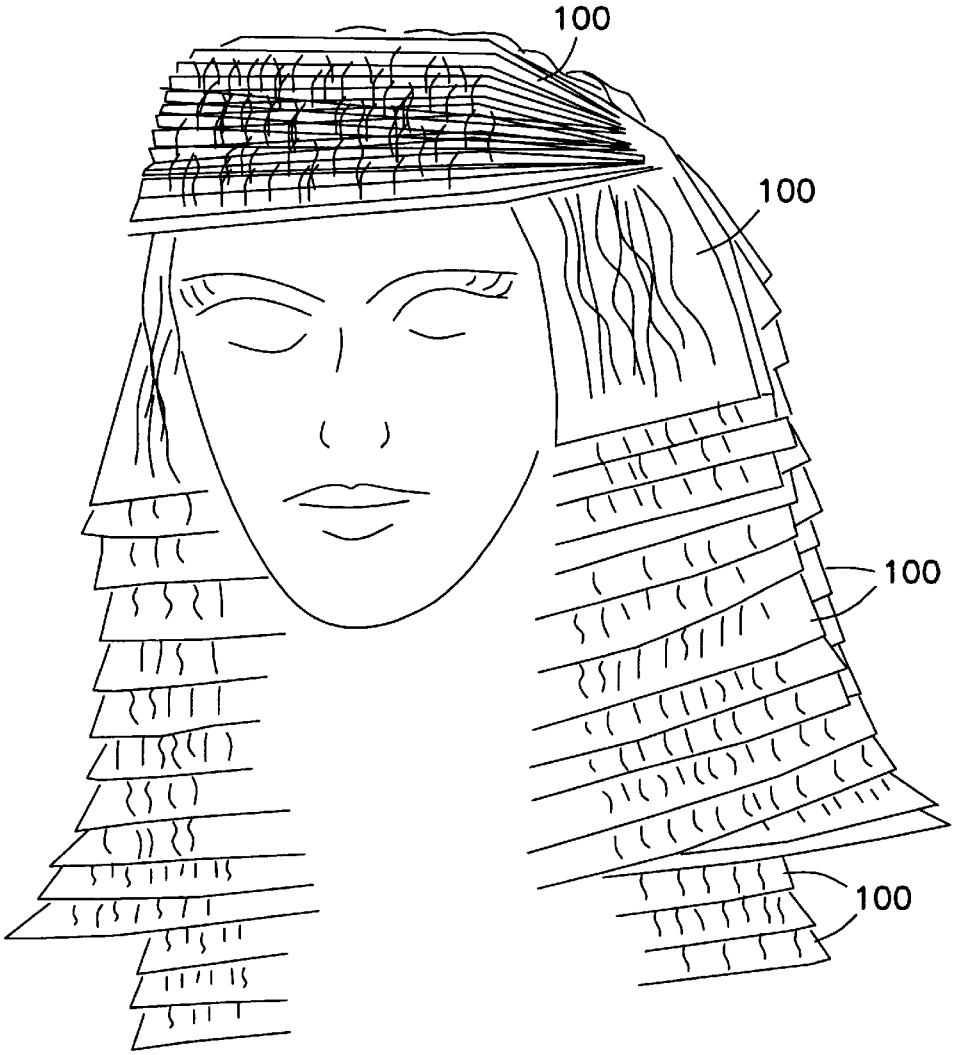
FIG. 8 is an isometric view of a client where multiple devices for applying chemical agents to selected strands of hair have been put in place.

FIG. 8 shows an isometric view of a client after multiple hair highlighting devices 100 for applying chemical agents to selected strands of hair have been placed onto a client's head. As many as 200 hair highlighting devices 100 may be used to complete a highlighting job. The time savings over using individual foil sheets will thus be multiplied by the number of hair highlighting devices used. Thus, the hair highlighting device 100 saves significant amounts of time. It should be noted that the individual hair highlighting devices are stacked one atop the other as shown in FIG. 8. Hair highlighting devices 100 are applied toward the top of the clients head first. Once one is applied, it is folded to a position where it is out of the way. The hairdresser then moves to an area just below the placement of the previously placed hair highlighting device 100, selects several strands of hair to apply chemicals to and place within the hair highlighting device 100. Strands of hair that are not selected hang free between the individually placed hair highlighting devices 100. These strands are also"folded up" and out of the way when the next hair highlighting device is added to the scalp of the client. When an entire section of the scalp has been treated, the various individual hair highlighting devices are folded down so that they hang from the scalp. The chemicals are allowed to act on the individual strands of hair for a selected amount of time and then the hair highlighting devices 100 are removed.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An apparatus for use in applying agents to selected strands of hair comprising:

a first sheet of foil having a first folded end and a first free end;

a second sheet of foil having a second folded end and a second free end, said first folded end wrapped around the second free end of the second sheet, said second folded end wrapped around the first free end of the first sheet.

2. The apparatus of claim 1, wherein the first folded end faces in a first direction and the second folded end faces in a second direction.

3. The apparatus of claim 1, wherein the apparatus comprises:

a first end;

a second end;

an intermediate portion between the first and second ends of the apparatus, each of said first end and said second end including three layers of foil, said intermediate portion having two layers of foil.

4. The apparatus of claim 1 wherein said first sheet of foil and said second sheet of foil have substantially the same dimensions.

5. The apparatus of claim 4 wherein said first sheet of foil and said second sheet of foil are dimensioned so that a selected number of strands of hair of a selected length will fit on one of said first or second sheets of foil.

6. An apparatus for applying coloring agents to selected strands of hair comprising:

a box having one open end;

a first sheet of foil having a first folded end and a first free end;

a second sheet of foil having a second folded end and a second free end, said first folded end wrapped around the second free end of the second sheet, said second folded end wrapped around the first free end of the first sheet, said second sheet of foil removably attached to the first sheet of foil and positioned within said box such that an end of the first and second sheet of foil is presented at the open end of the box.

7. An apparatus for applying coloring agents to selected strands of hair comprising:

a box having one open end;

a first sheet of foil wherein said first sheet of foil further comprises:

a first folded end; and a first free end; and wherein the second sheet of foil further comprises:

a second folded end; and a second free end, said first folded end wrapped around the second free end of the second sheet, said second folded end wrapped around the first free end of the first sheet, said second sheet of foil removably attached to the first sheet of foil and positioned within said box such that an end of the first and second sheet of foil is presented at the open end of the box.

8. The apparatus of claim 7 wherein one of the first folded end or the second folded end are presented to the open end of the dispenser.

9. The apparatus of claim 7 wherein said first sheet of foil and said second sheet of foil have substantially the same dimensions.

10. The apparatus of claim 9 wherein said first sheet of foil and said second sheet of foil are dimensioned so that a selected number of strands of hair of a selected length will fit on said first sheet of foil as engaged with said second sheet of foil.

11. The apparatus of claim 9 wherein said first sheet of foil and said second sheet of foil are dimensioned so that said first sheet of foil and said second sheet of foil will fit within the dimensions of the box while lying in the box.

12. The apparatus of claim 7 further comprising a plurality of said second sheet of foil removably attached to the first sheet of foil stacked within said box such that an end of each of the first and second sheets of foil is presented at the open end of the box.

13. A method for applying chemicals to hair comprising the steps of:

placing two sheets of material adjacent one another;

placing an edge of the two sheets of material near the scalp of a person;

selecting strands of hair;

applying chemicals to said selected strands of hair; and removing one of the two adjacent sheets and placing one of the two adjacent sheets atop the other sheet.

14. The method of claim 13 further comprising the step of sealing the first sheet and the second sheet to contain the chemicals and selected strands of hair therein.

15. The method of claim 14 wherein the material is aluminum foil.

16. The method of claim 15 wherein the step of sealing the first sheet and the second sheet to contain the chemicals and selected strands of hair therein comprises the step of crimping the edges of the first and second sheet of aluminum foil together.

* * * * *